US006220670B1

(12) United States Patent
Mraz

(10) Patent No.: US 6,220,670 B1
(45) Date of Patent: Apr. 24, 2001

(54) METHOD AND APPARATUS FOR REMOTE SELF-PROPELLED CONVEYING IN MINERAL DEPOSITS

(75) Inventor: Dennis Mraz, Saskatoon (CA)

(73) Assignee: DM Technologies, Inc., Saskatoon (CA)

( * ) Notice: Subject to any disclaimer, the term of this patent is extended or adjusted under 35 U.S.C. 154(b) by 0 days.

(21) Appl. No.: 09/250,689

(22) Filed: Feb. 16, 1999

(51) Int. Cl.[7] ..... E21C 29/00; E21C 35/08; E21C 35/24

(52) U.S. Cl. ..... 299/18; 299/30; 299/67; 299/73; 198/303; 198/587

(58) Field of Search ..... 299/18, 30, 64, 299/67, 73, 31; 198/587, 588, 303

(56) References Cited

U.S. PATENT DOCUMENTS

| | | | | |
|---|---|---|---|---|
| 2,826,402 | | 3/1958 | Alspaugh et al. | 299/30 |
| 3,497,055 | | 2/1970 | Oslakovic et al. | 299/30 |
| 4,226,476 | * | 10/1980 | Fairchild et al. | 299/31 |
| 4,390,211 | * | 6/1983 | thompson | 299/64 |
| 4,784,257 | * | 11/1988 | Doerr | 198/303 |
| 4,869,358 | * | 9/1989 | Chandler | 299/31 |
| 5,112,111 | | 5/1992 | Addington et al. | 299/18 |
| 5,232,269 | | 8/1993 | Addington et al. | 299/67 |
| 5,246,274 | * | 9/1993 | Smith et al. | 299/64 |
| 5,261,729 | | 11/1993 | Addington et al. | 299/64 |
| 5,609,397 | | 3/1997 | Marshall et al. | 299/67 |
| 5,692,807 | | 12/1997 | Zimmerman | 299/67 |
| 5,810,447 | * | 9/1998 | Christopher et al. | 299/30 |
| 5,938,289 | * | 8/1999 | Antoline et al. | 299/67 |

* cited by examiner

*Primary Examiner*—Eileen D. Lillis
*Assistant Examiner*—John Kreck
(74) *Attorney, Agent, or Firm*—Swidler Berlin Shereff Friedman LLP

(57) ABSTRACT

A method and apparatus for mining of aggregate material from a seam includes a mining apparatus and a self-propelled conveyor capable of advancing or retreating in the seam on its own power and advancing and steering arrangement for the mining apparatus. The self-propelled conveyor, the electric cables and other services for the mining apparatus are protected against the roof falls. The power input for the self-propelled conveyor is provided by continuous drive shafts powered at either one or both ends of the conveyor. Alternately, a unique reciprocating conveyor mechanically powered at either one or both ends of is provided for conveying of aggregate material. An apparatus for assembling the conveyor and receiving of aggregate material is provided at the rear end of the conveyor.

47 Claims, 20 Drawing Sheets

METHOD AND APPARATUS FOR REMOTE SELF-PROPELLED CONVEYING IN MINERAL DEPOSITS

FIELD OF THE INVENTION

The present invention relates generally to mining and specifically to conveying in remote mining of bedded mineral deposits.

BACKGROUND OF THE INVENTION

Methods of remote mining in bedded mineral deposits such as coal seams employ a mining machine that excavates mine openings to some distance from the seam exposure on the surface and means of conveying are required to transport the excavated material to the surface. In most of the present systems, means of conveying consisting of multiple conveyors are advanced into the mine openings from the surface. For example, U.S. Pat. Nos. 5,112,111, 5,232,269 and 5,261,729 to Addington at al. disclose an assembly of conveyors and a mining machine advanced into the seam without interrupting the flow of aggregate material by separate means designed to pull at the forward end and push at the rearward end. Similarly, U.S. Pat. No. 5,609,397 to Marshall at al. discloses an assembly of conveyors interconnected with a mining machine and a driving device located outside the seam and consisting of rack and pinion or, alternately, reciprocating cylinders, linear tracks, linear or rotary drives, chains, cables or other mechanical devices. The U.S. Pat. No. 5,692,807 to Zimmerman discloses a guidance assembly for extending and retracting an assembly of conveyors in and out of the seam. The U.S. Pat. No. 3,497,055 to Oslakovic at al. discloses a multi-unit train of conveyors having a self-propelled unit at each end coupled to intermediate units, each end unit being capable of towing the intermediate units. The U.S. Pat. No. 2,826,402 to Alspaugh at al. discloses a train of wheeled conveyor sections pulled into the mine opening and pushed out of it by a self-propelled mining machine. Buckling of the train is avoided by the grooves made by the mining machine in the floor, said grooves spaced the same distance as the treads of the wheels carrying the conveyor sections.

At present, as the interconnected assembly of the mining machine and a plurality of conveyors is advanced some distance into the seam from a launch vehicle located on the outside, the axial force within the assembly becomes excessive with respect to it's length and the assembly becomes less rigid. As a consequence, it becomes difficult to steer the mining machine located at the front of the assembly and the conveying assembly itself can become unstable, which limits the penetration depth of mining. As well, pulling the conveying assembly at the rearward end when it becomes entrapped by a rock fall may sometimes cause the conveying assembly to brake. It would be therefore desirable to provide means of advancing and withdrawing of the conveying assembly that minimizes the axial force within the conveying assembly.

Where the conveying means consists of a plurality of conveyor units, each of the individual conveyors requires a separate input of electric power which, in turn, requires coupling and uncoupling of electrical cables as the assembly is advanced into or retracted from the mine opening. It would be therefore desirable to provide a power input that does not require electric power at each individual conveyor of the assembly.

If the electric power input is not provided at each individual conveyor, the conveying assembly cannot be extended without interrupting of conveying, as claimed in the U.S. Pat. No. 5,112,111 to Addington at al. It would be therefore desirable to provide means of extending the conveying assembly that minimizes the time required for an extension of the assembly.

Where open conveyors are used, they are prone to damage by falls of rock from unsupported roof. Often, when rock falls occur, mining must be interrupted and the conveying assembly brought to the surface, in order to remove rock fallen onto the assembly and repair damage. It would be therefore desirable to provide means of conveying that is enclosed in a protective enclosure, capable of withstanding at least moderate rock falls.

Electric cables, control cables and hoses for the remote mining machine that lay on the top of the conveying assembly are also prone to damage by rock falls. It would be therefore desirable to provide protective enclosures for cables, hoses and other services provided for the remote mining machine.

The remote mining machine located at the forward end of the conveying assembly may become entrapped by fallen rock and the traction force of the said conveying assembly may not be sufficient to extract the said mining machine. It would be therefore desirable to provide independent means of extracting the mining machine from the seam.

SUMMARY OF THE INVENTION

Accordingly, it is an object of the present invention to provide a method and apparatus for advancing a remote conveying assembly without causing excessive axial forces within the said assembly, by providing tractive forces at multiple locations along the length of the said assembly.

Another object of the present invention is to provide a method and apparatus for remote conveying that does not require electric power at each conveying section of the conveying assembly.

Another object of the present invention is to provide a method and apparatus for extending of the conveying assembly that minimizes the time required for extensions.

Another object of the present invention is to provide a method and apparatus for protecting the remote conveying assembly, electric cables and other services from damage by rock falls.

Another object of the present invention is to provide a method and apparatus for advancing and steering of the remote mining machine independently of advancing of the conveying assembly.

These and other objects of the present invention will become clear from the detailed description of the invention and the claims included below.

DETAILED DESCRIPTION OF THE PREFERRED EMBODIMENTS

Figure 1:
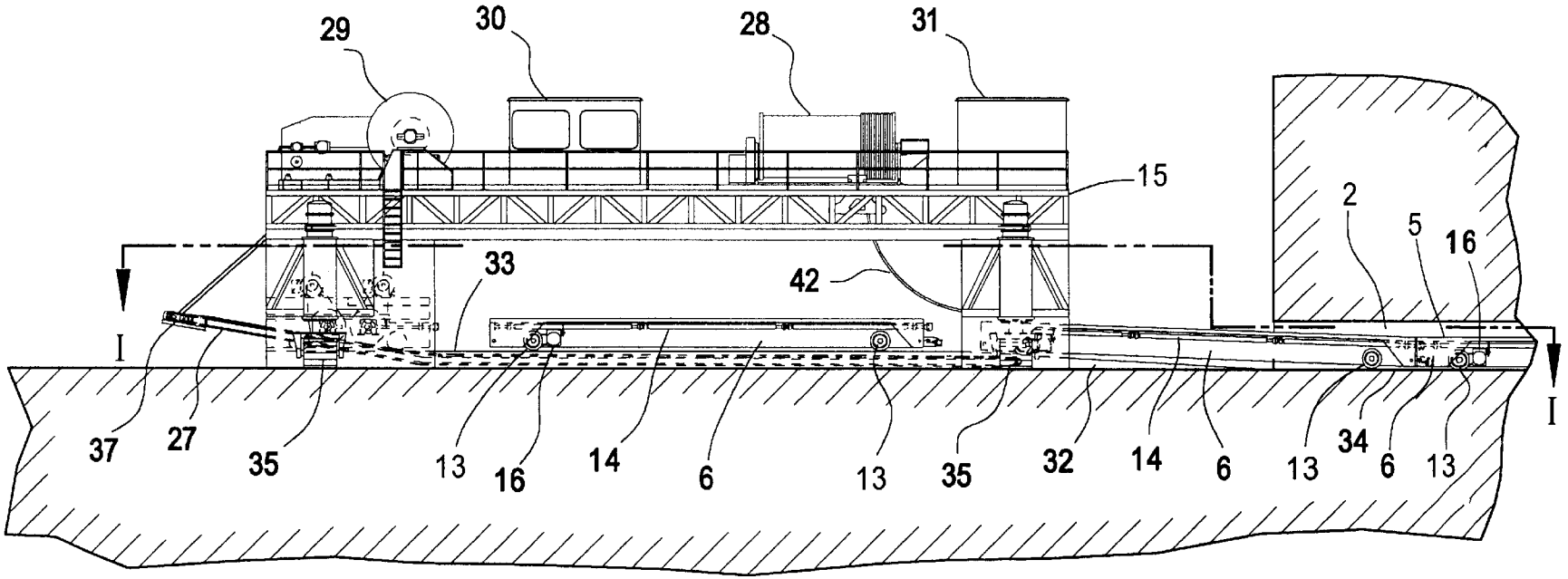
FIG. 1 is a schematic side view of the first part of the preferred embodiment of the present invention located outside the seam, including a mining platform, stacker and a rearward end of the conveying assembly.
Figure 1A:
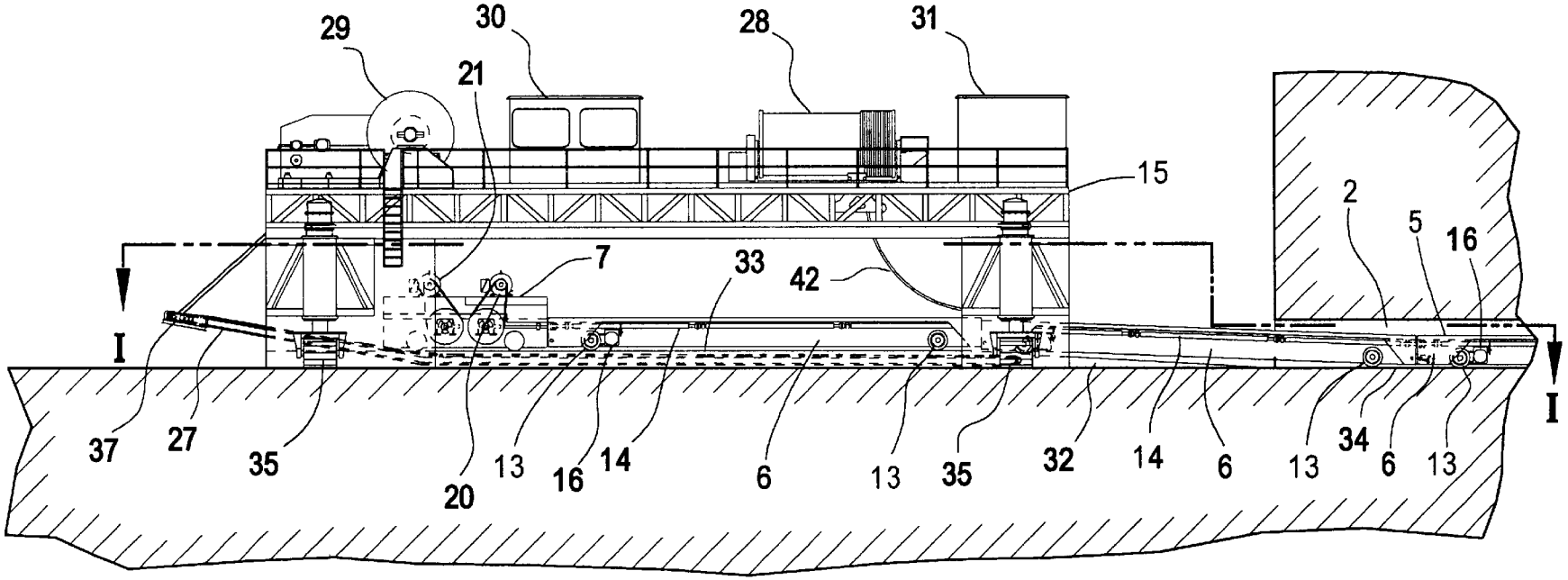
FIG. 1A is a schematic side view of the assembly in FIG. 1, showing the conveying assembly advancing into the seam.
Figure 2:
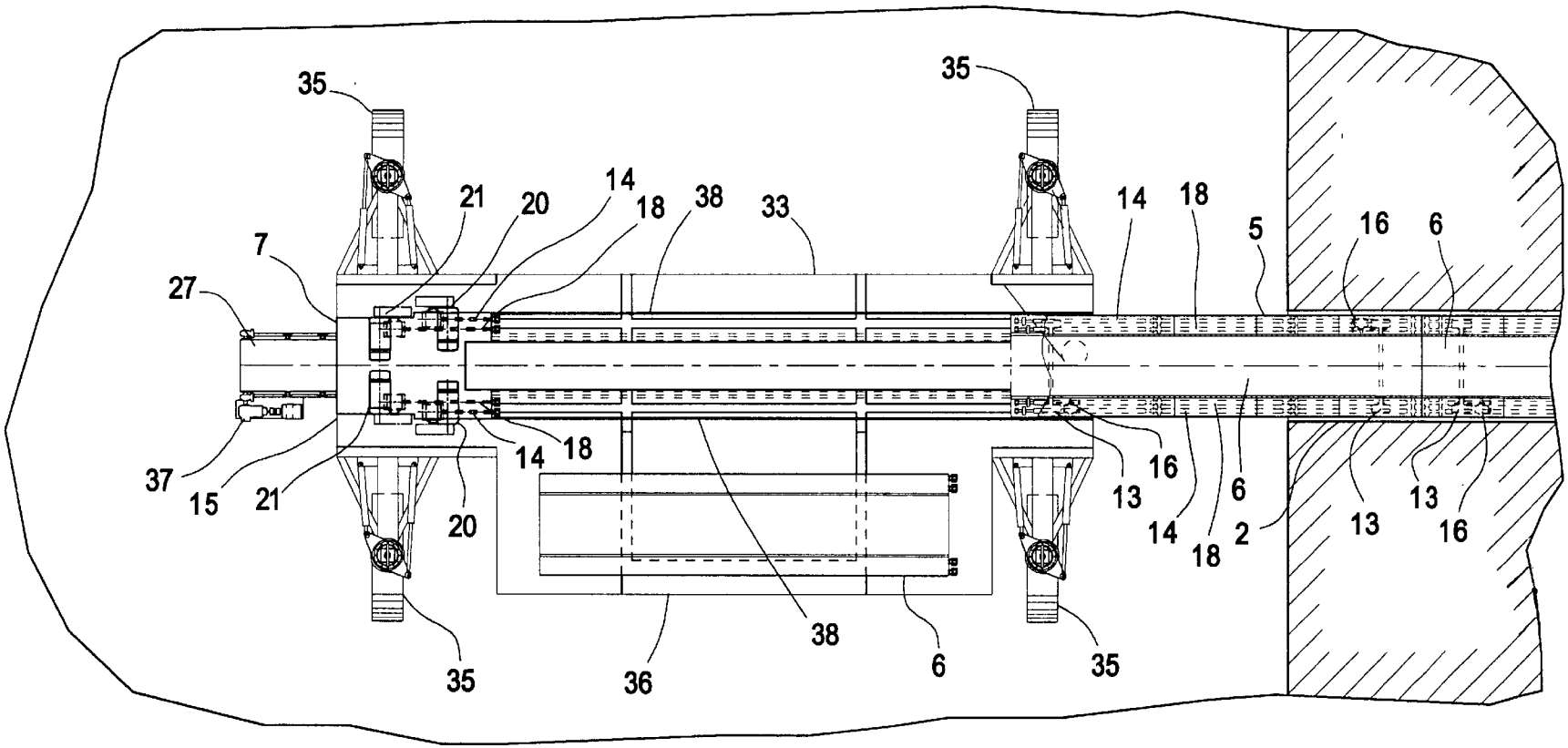
FIG. 2 is a schematic plan view taken along line I—I of FIG. 1.
Figure 2A:
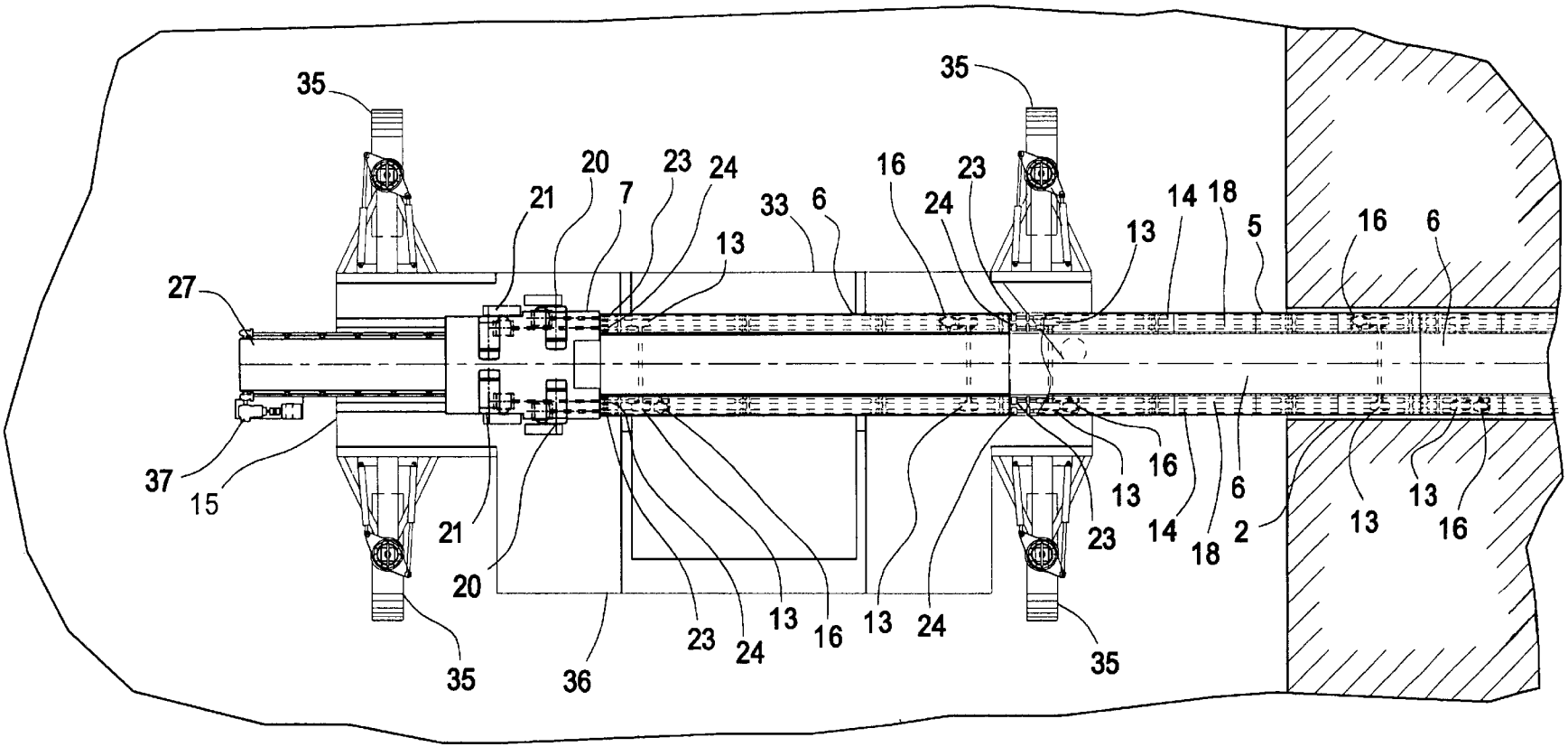
FIG. 2A is a schematic plan view taken along line I—I of FIG. 1A.
Figure 3:
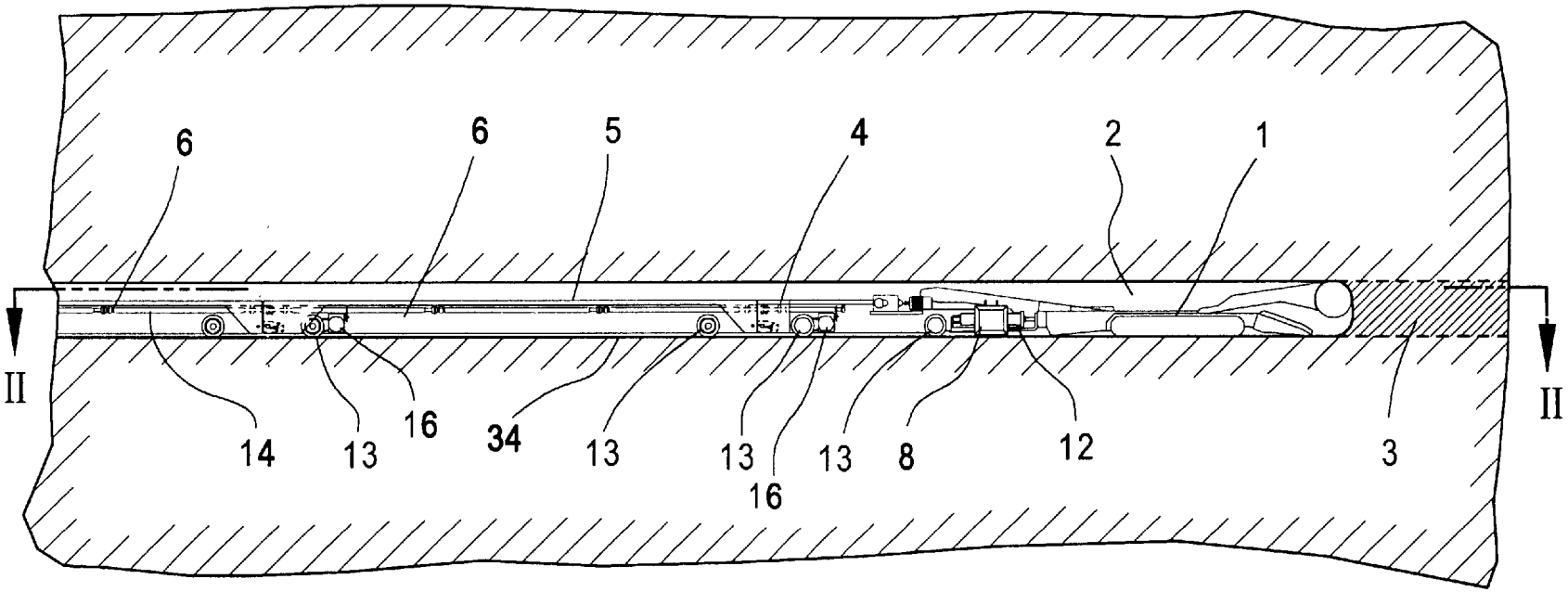
FIG. 3 is a schematic side view of the second part of the preferred embodiment of the present invention, located inside the seam, including a forward end of the conveying assembly, feeder/breaker, advancing cylinders, side jacks and a mining machine.
Figure 4:
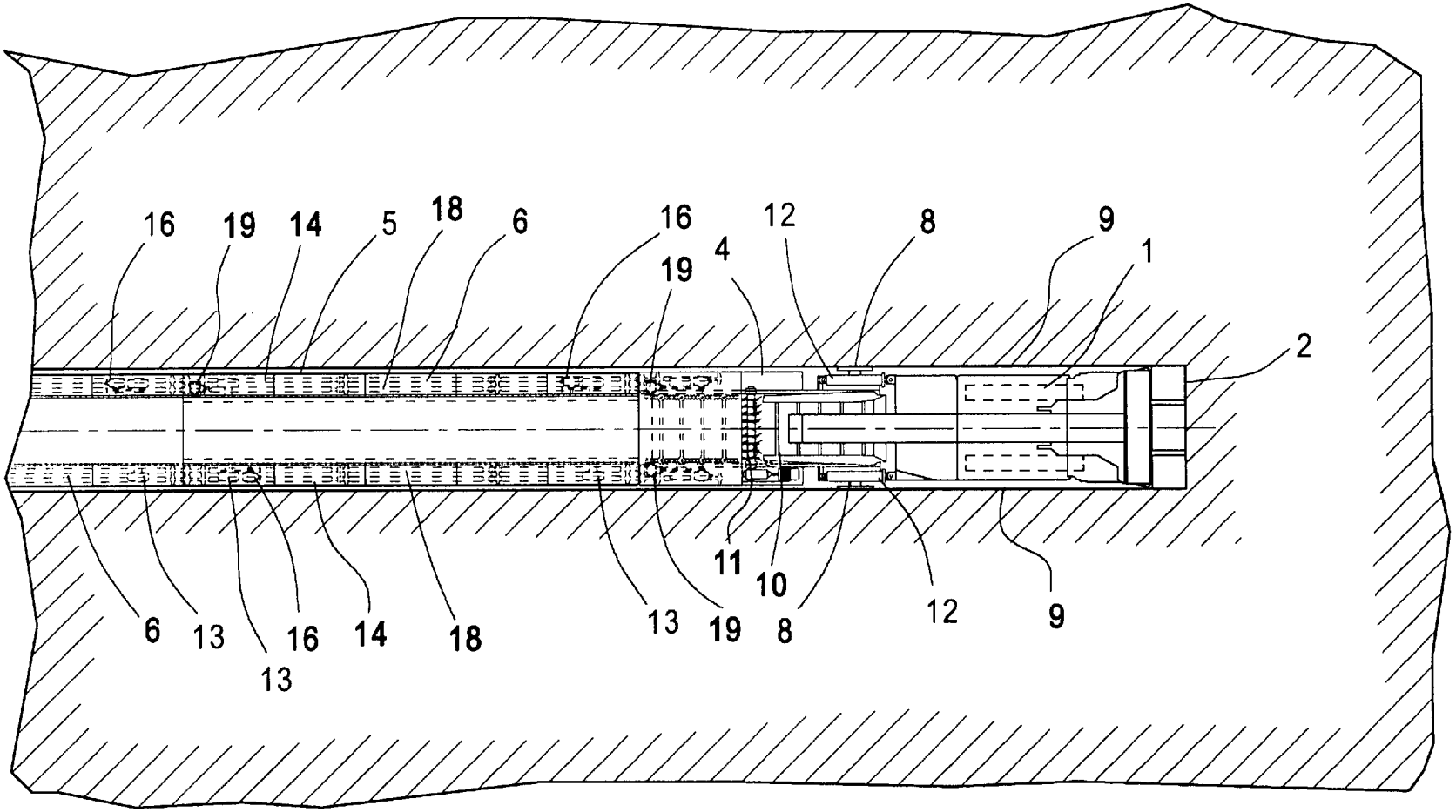
FIG. 4 is a schematic plan view taken along line II—II of FIG. 3.
Figure 4A:
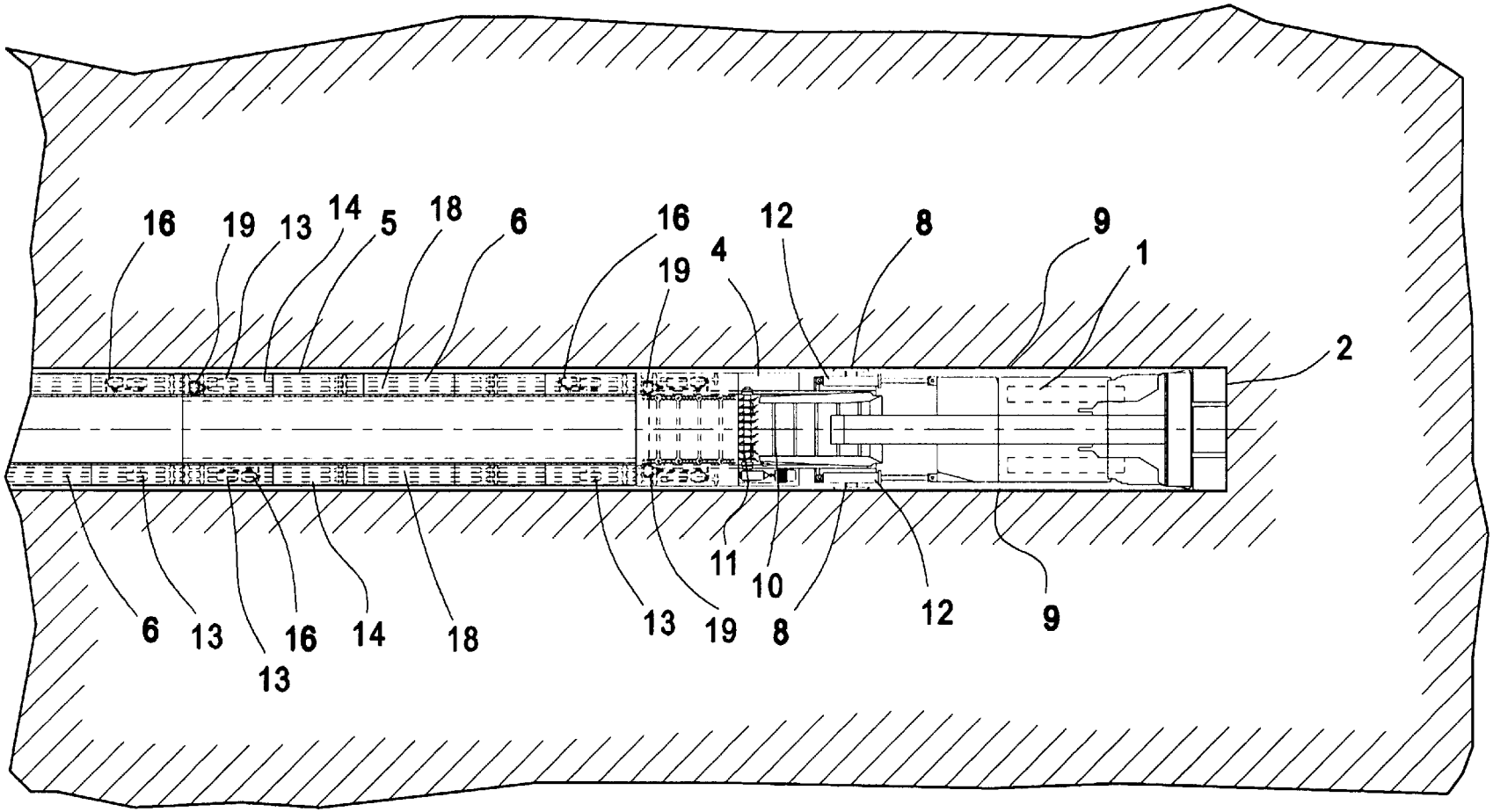
FIG. 4A is a schematic plan view taken along line II—II of FIG. 3, showing the advancing cylinders extended and the mining machine advanced ahead of the conveying assembly.
Figure 5:
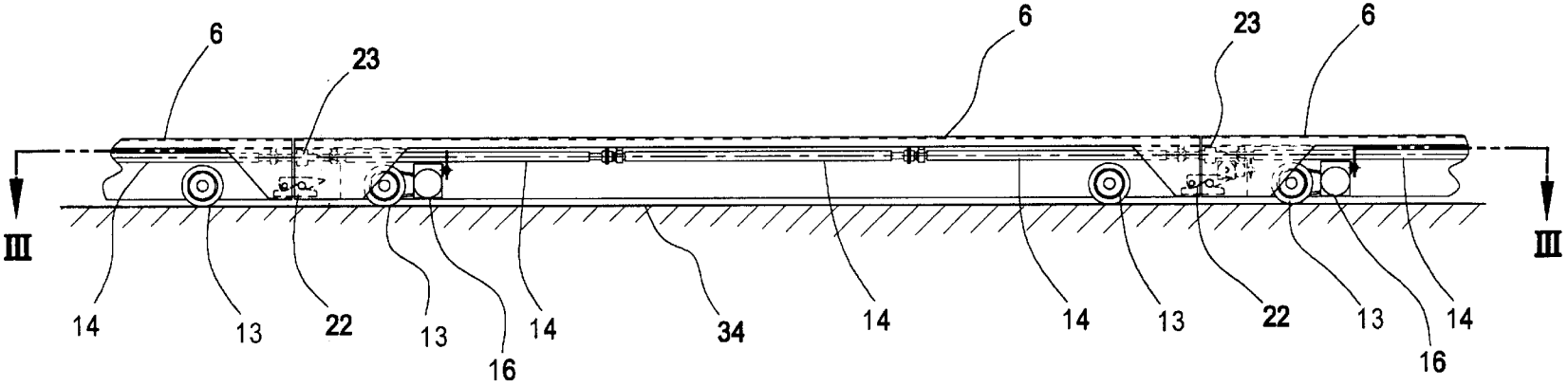
FIG. 5 is a schematic side view of a component of the conveying assembly utilizing belt conveyors.
Figure 6:
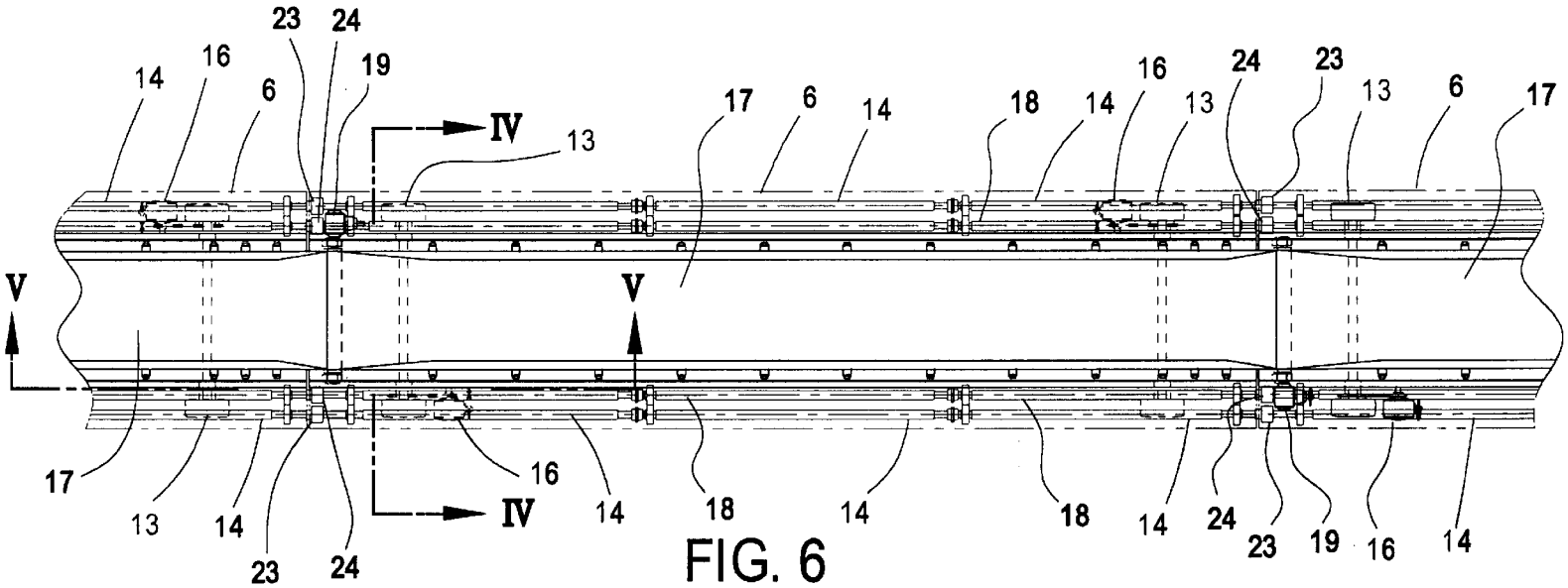
FIG. 6 is a schematic plan view taken along line III—III of FIG. 5.
Figure 7:
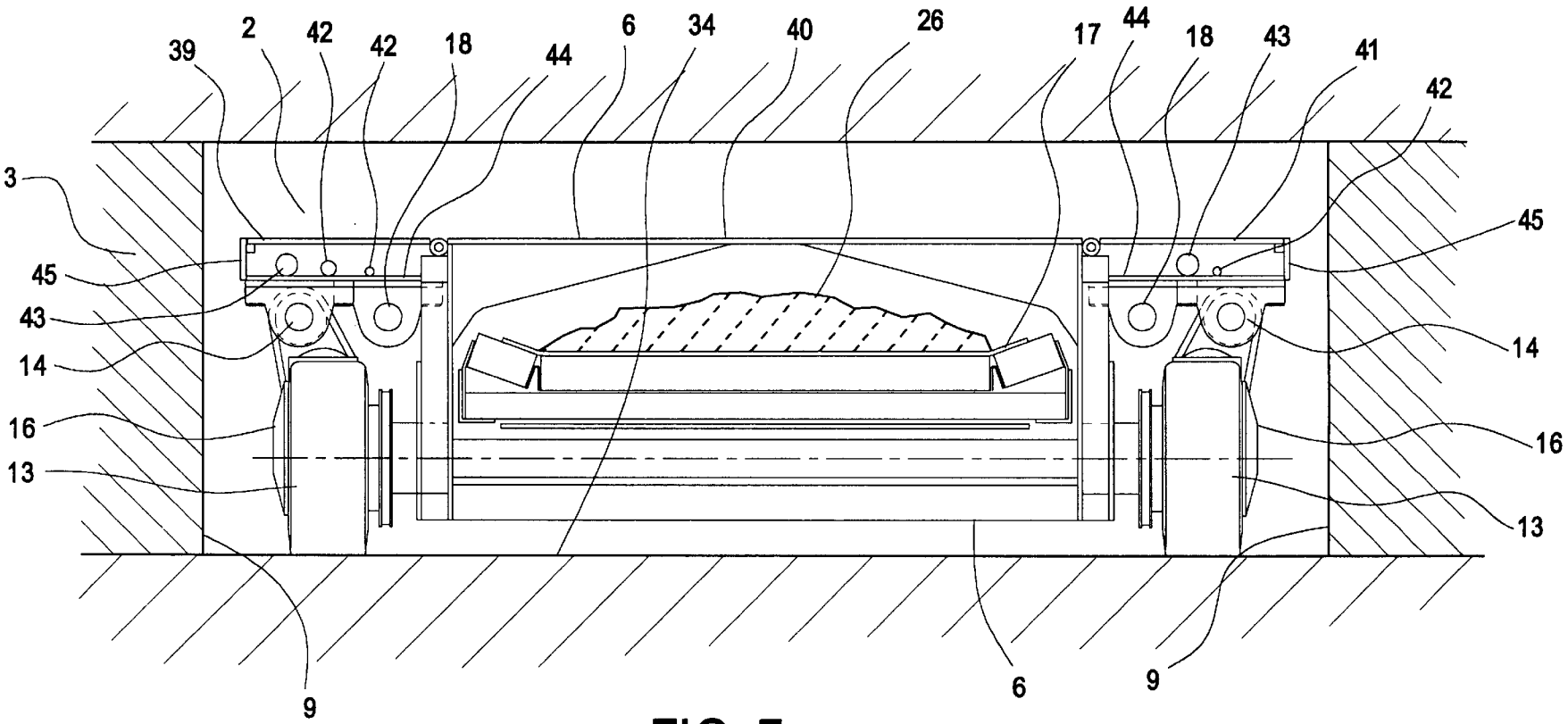
FIG. 7 is a schematic sectional view taken along line IV—IV of FIG. 6.
Figure 8:
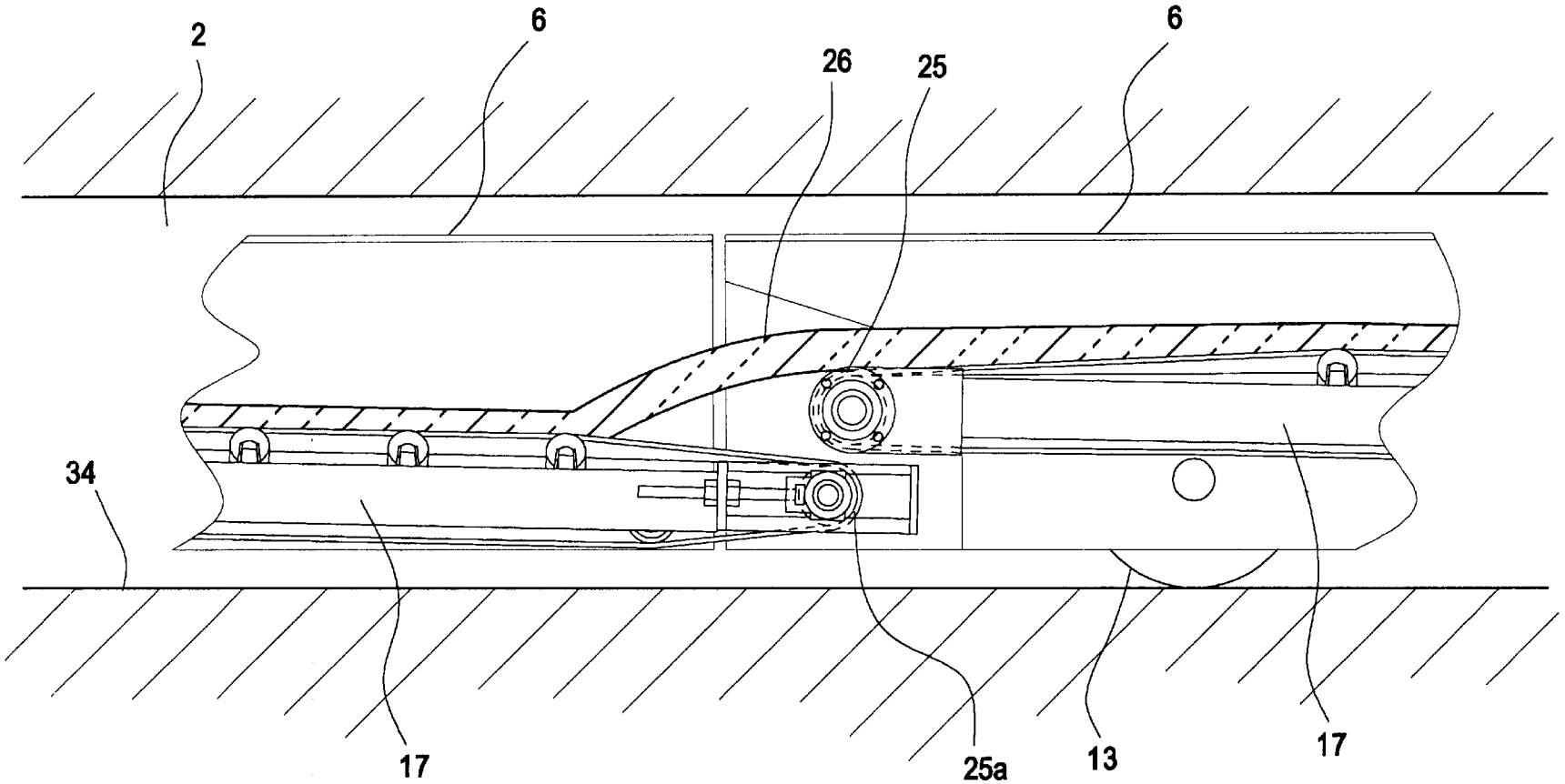
FIG. 8 is a schematic sectional view taken along line V—V of FIG. 6.

Referring to FIG's 1 through 8, a remote mining machine 1 excavates mineral in the mine opening 2 within a seam 3. The mining machine 1 discharges the excavated material onto the receiving module 4 of the self-propelled conveying assembly 5. The self-propelled conveying assembly 5 consists of the receiving module 4, a plurality of intermediate modules 6 and a drive module 7. The mining machine 1 is connected to the receiving module 4 with advancing cylinders 12 which are used to advance the mining machine 1 into the mining room 2 and also to directionally steer it. The receiving module 4 also carries side jacks 8. Side jacks 8 are normally used for steering the receiving module 4 within the mine opening 2. However, if the mining machine 1 is trapped by a rock fall, the side jacks 8 are braced between the walls 9 of the mine opening 2 and cylinders 12 are used to extract the mining machine 1 from under the rock fall. Where necessary, the receiving module 4 carries a feeder 10 and a breaker 11.

A very important aspect of this invention is the manner in which the self propelled conveying assembly 5 advances into the mine opening 2 excavated by the mining machine 1. Unlike other systems currently in use, all modules of the conveying assembly 5, including all the intermediate modules 6 and the receiving module 4 have each one or more driven axles 13 capable of generating a traction force to propel the conveying assembly either forward or backward. Driven axles 13 receive power from one or more drive shafts 14 driven from the drive module 7 located on the mining platform 15, through drives 16. As all the driven axles 13 are interconnected through the drive shafts 14, they are forced to advance or retreat at the same speed, regardless of the torque they may require. The whole conveying assembly 5 advances or retreats at the same speed without any appreciable push or pull within the said conveying assembly 5, thus assuring a uniform and problem-free advance or retreat.

In the preferred embodiment of the present invention, the individual conveyors 17 mounted within the intermediate modules 6 and the feeder 10 of the receiving module 4 also receive power from at least one drive shaft 18 driven from the drive module 7 located on the mining platform 15, through drives 19.

The drive car 7 includes tram power drives 20 that power the drive shafts 14 and conveyor power drives 21 that power the drive shafts 18.

During the advancing or retrieval operation, all components of the conveying assembly 5 including the drive module 7, the intermediate modules 6 and the receiving module 4 are coupled together by couplings 22 while the drive shafts 14 are coupled together by drive couplings 23 and drive shafts 18 are coupled by drive couplings 24. When the intermediate modules 6 are coupled, the head ends 25 and the tail ends 25A of the conveyors 17 overlap in order to facilitate transfer of the aggregate material 26.

The mining platform 15 includes a discharge conveyor 27, the drive module 7, cable and hose winders 28, winches 29, a control room 30, an electrical room 31, a retractable ramp 32, and other required equipment and facilities. The retractable ramp 32 accommodates the elevation difference between the bottom deck 33 of the platform 15 and the bottom 34 of the seam 3. Tracks 35 or other means of propel are provided to facilitate positioning of the mining platform 15 with respect to the mine opening 2.

An important aspect of this invention is the method and apparatus of adding intermediate modules 6 to the conveying assembly 5. The extended bottom deck 33 includes a sliding table 36. A cargo handling equipment such as a commonly available fork lift or a front-end loader is used to deposit an intermediate module 6 onto the sliding table 36. When the conveying assembly 5 advances into the mine opening 2 a full length of one intermediate module 6, the drive module 7 is disconnected from the last rearward intermediate module 6 and moved toward the discharge end 37 of the discharge conveyor 27, by a moving mechanism 38 attached to the drive module 7, thus generating a gap in the conveying assembly 5 that is greater than the length of on intermediate module 6. The sliding table 36 with an intermediate module 6 is moved sideways until the intermediate module 6 is lined up with the conveying assembly 5 at which point the drive module 7 is moved toward the new intermediate module 6 and all the components of the conveying assembly 5 are reconnected. As the drive shafts 14 and 19 are also reconnected through couplings 23 and 24, all axles 13 and conveyors 17 are powered and begin operating.

The intermediate modules 6 contain protective plates 39, 40 and 41 in order to protect mechanical and electrical components of the conveying assembly 5, including conveyor 17, electrical cables 42 and hoses 43. For this purpose, the electrical cables 42 and the hoses 43 and laid into structural trays 44. The sides 45 of the structural trays 44 also perform a function of guiding the conveying assembly 5 within the walls 9 of the mine opening 2.

Figure 9:
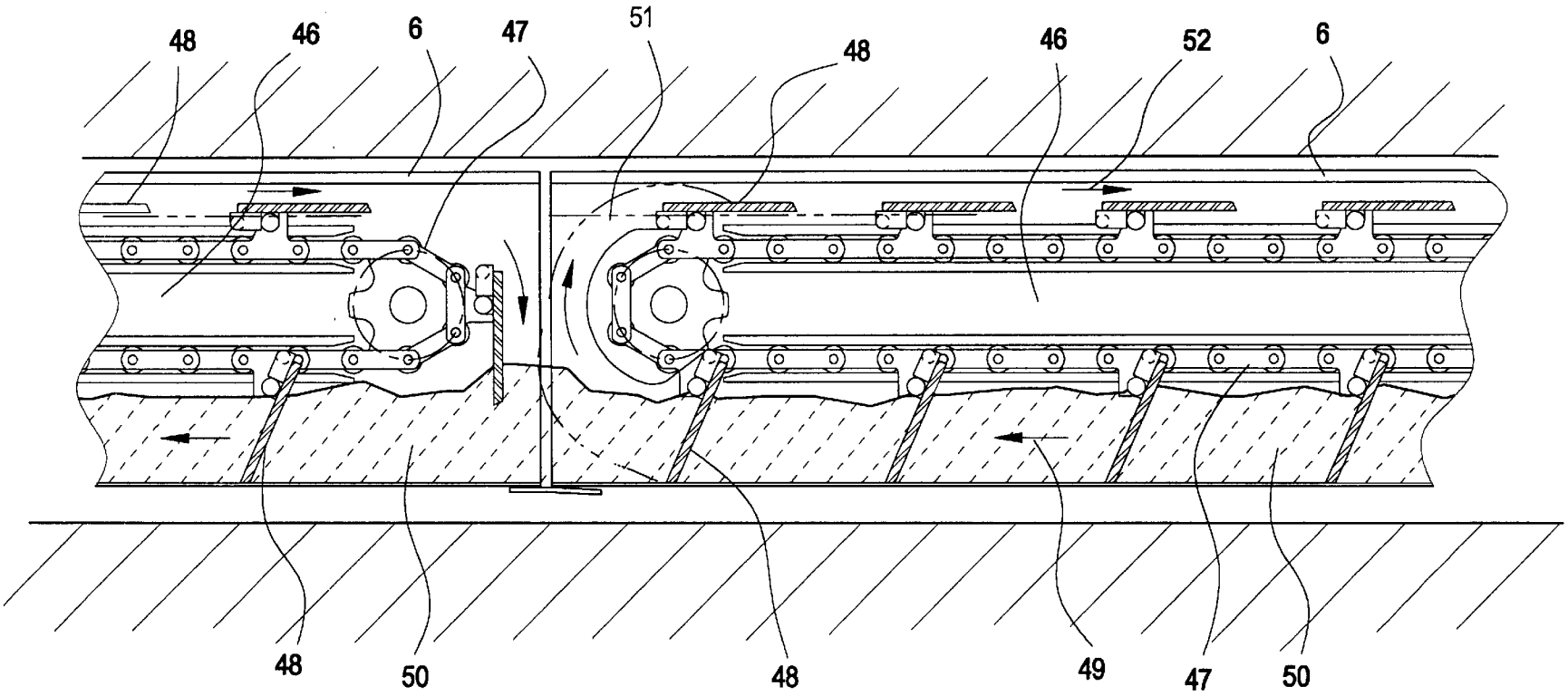
FIG. 9 is a schematic sectional view similar to FIG. 8, utilizing chain conveyors.
Figure 10:
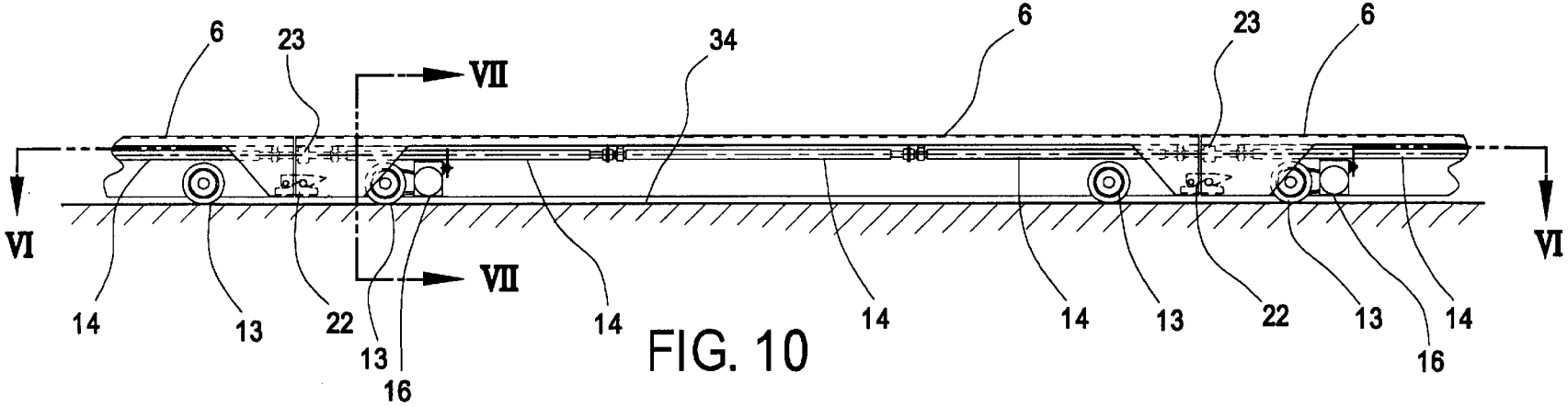
FIG. 10 is a schematic side view of a component of the conveying assembly utilizing a reciprocating conveyor.
Figure 11:
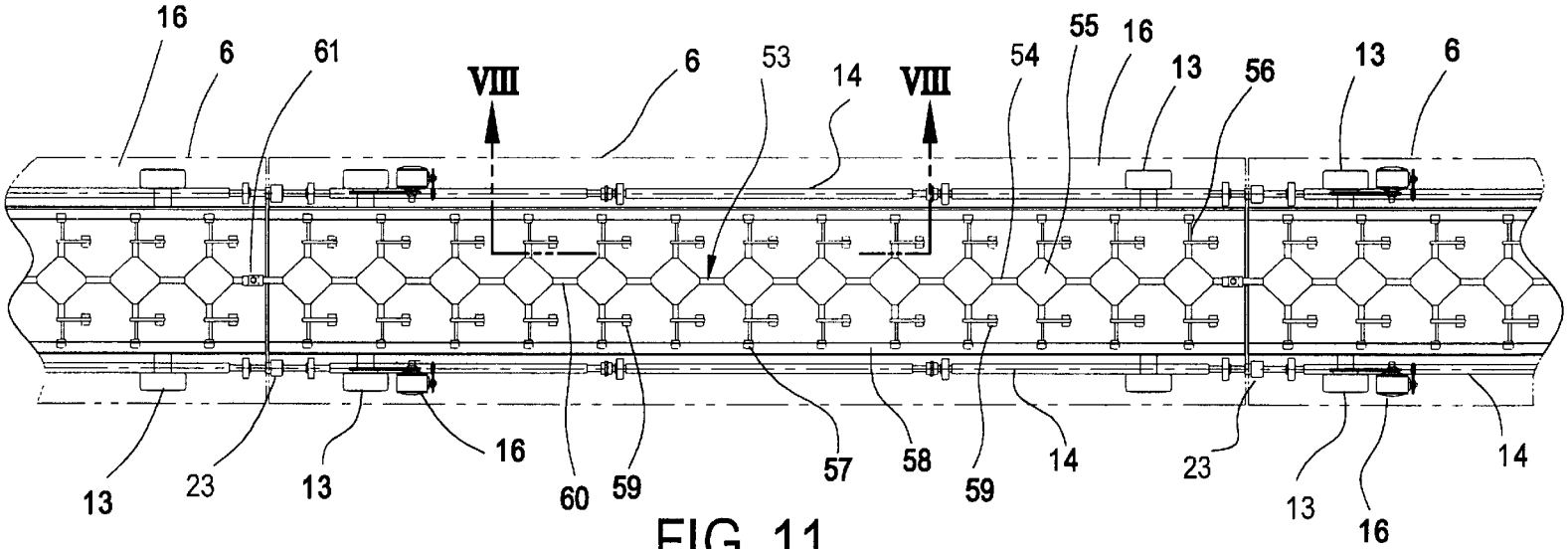
FIG. 11 is a schematic plan view taken along line VI—VI of FIG. 10.
Figure 12:
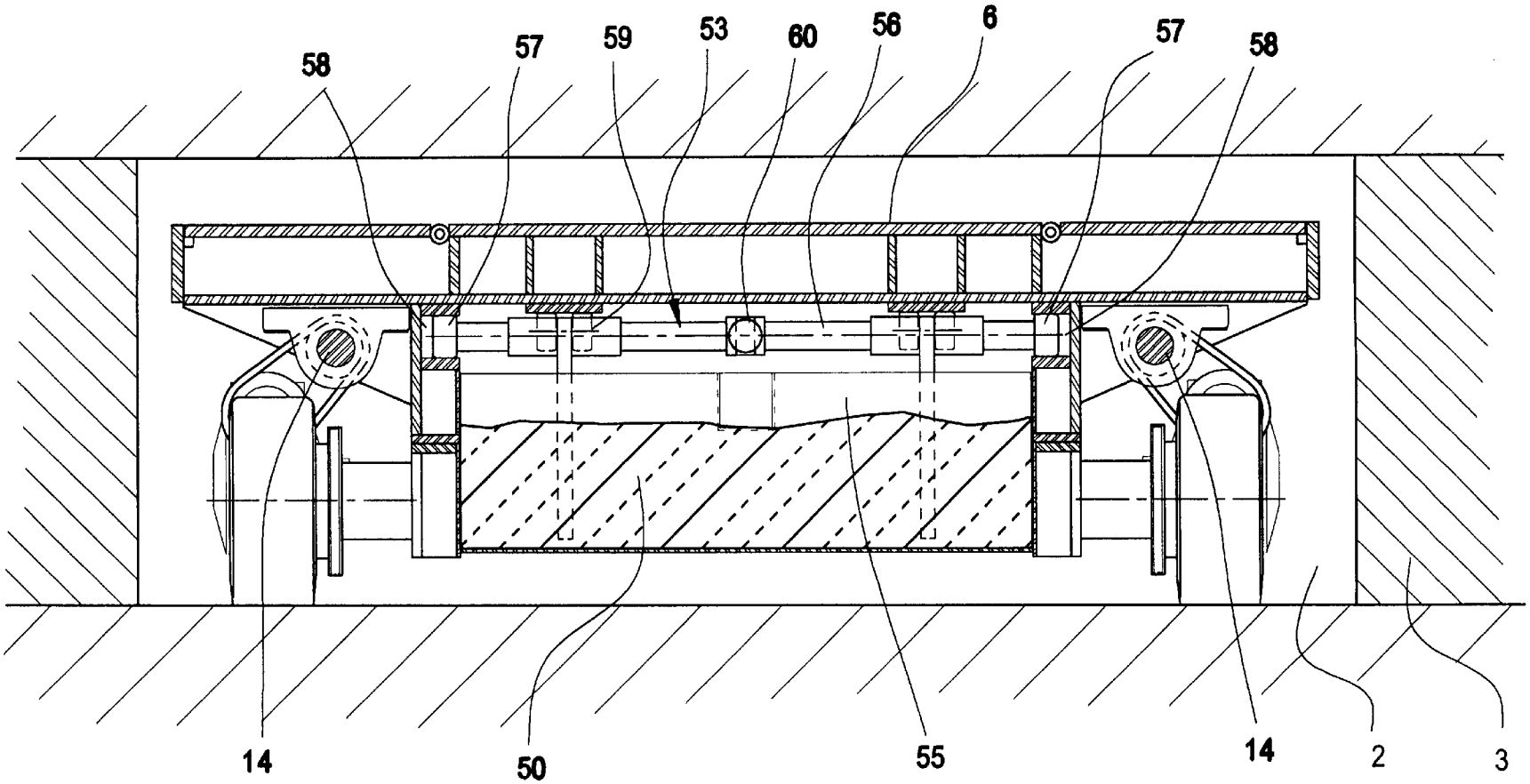
FIG. 12 is a schematic sectional view taken along line VII—VII of FIG. 10, of a preferred embodiment of reciprocating conveyor utilizing push plates.
Figure 13:
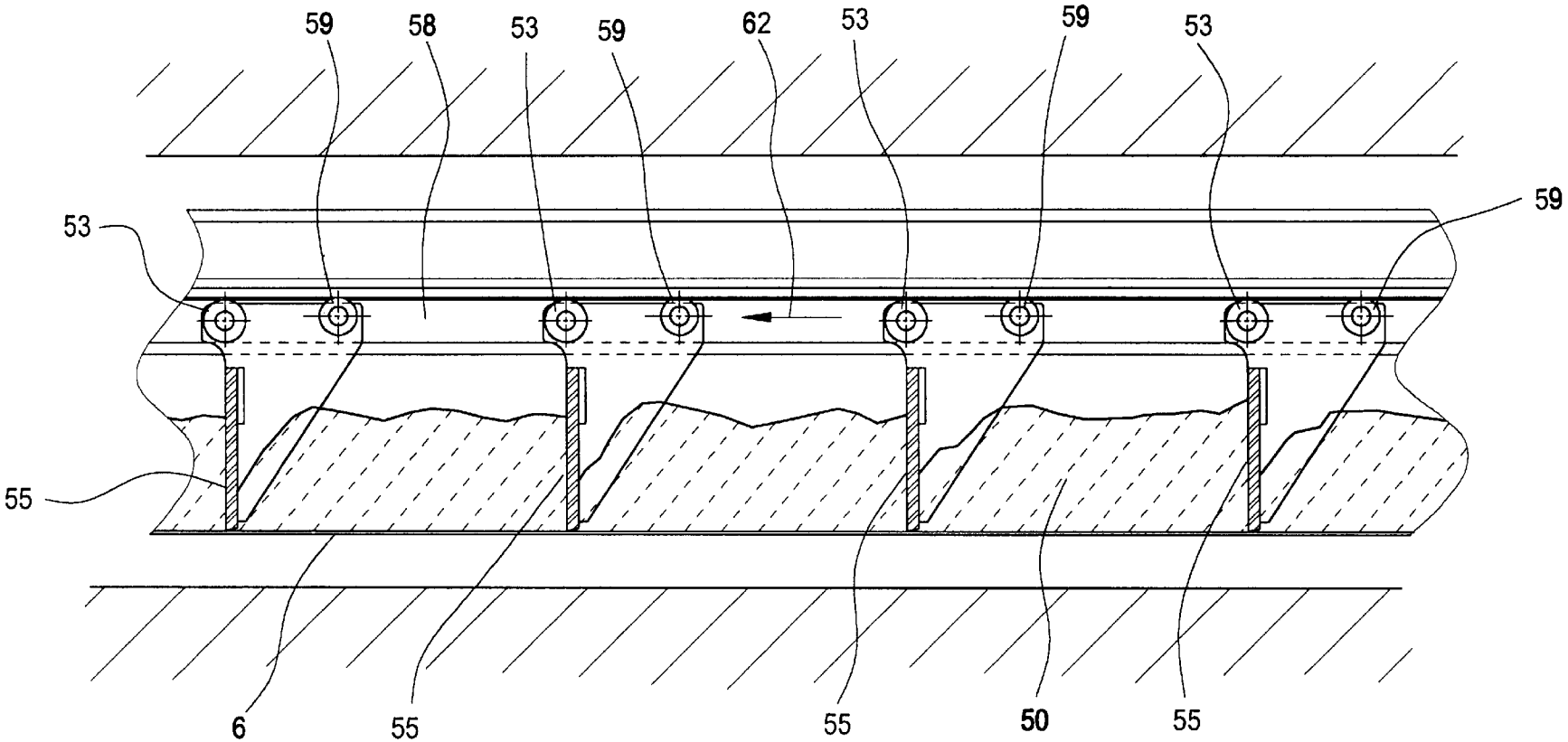
FIG. 13 is a schematic sectional view taken along line VIII—VIII of FIG. 10, of a preferred embodiment of reciprocating conveyor utilizing push plates, with push plates in a rearward motion.
Figure 14:
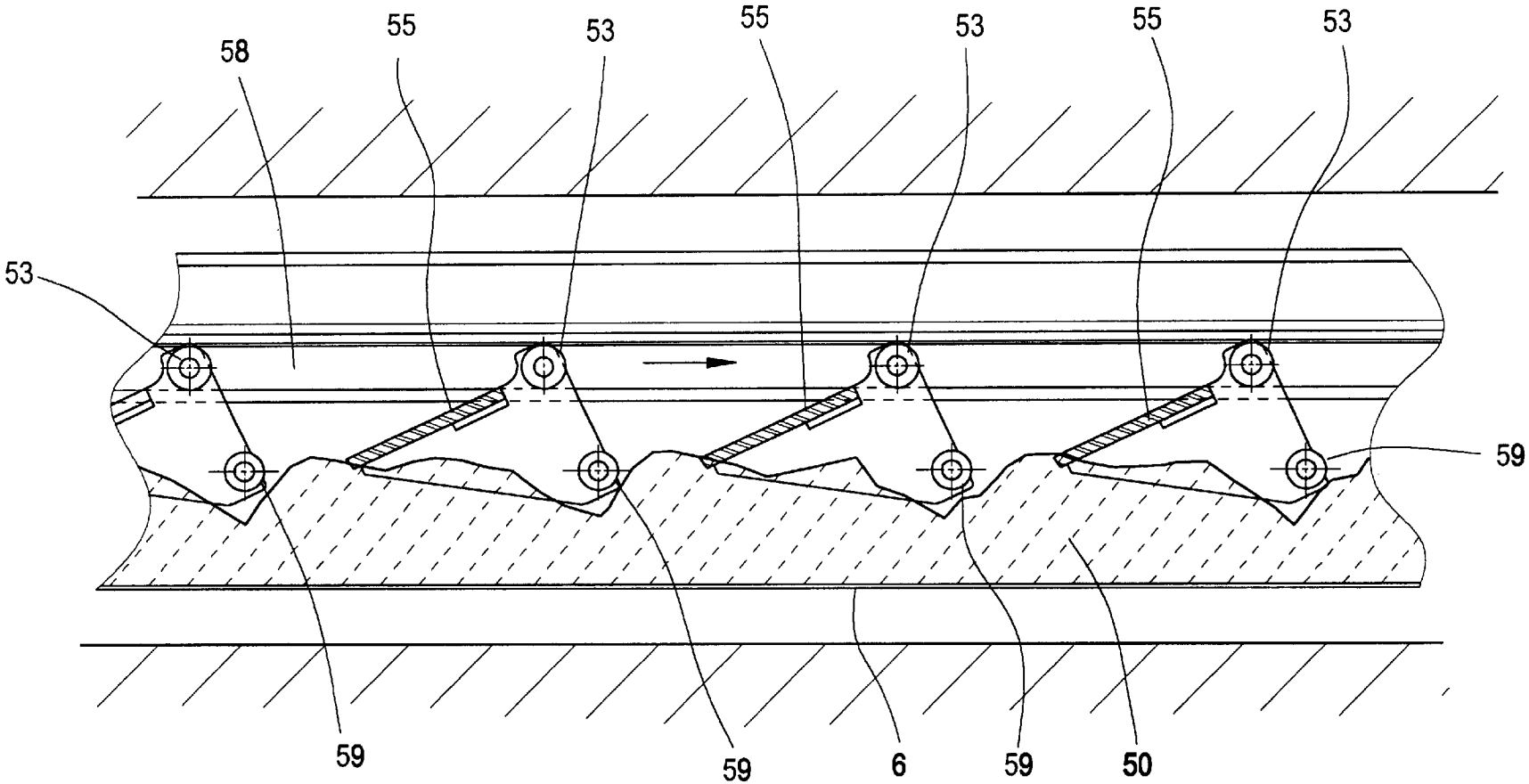
FIG. 14 is a schematic sectional view taken along line VIII—VIII of FIG. 10, of a preferred embodiment of reciprocating conveyor utilizing push plates, with push plates in a forward motion.

Referring to FIG. 9, chain conveyors 46 are mounted within the intermediate modules 6. The chain 47 includes flights 48 that swing downwards by gravity when they travel in the direction of transport shown by an arrow 49 and push the aggregate material 50 within the intermediate module 6. In order to make the conveyors 46 more space efficient, a cam 51 swings the flights 48 to a horizontal position during their return path shown by an arrow 52.

FIGS. 10 through 14 show a schematic of the intermediate modules 6 with a reciprocating conveyor 53. Each module 6 contains a section 54 of a reciprocating conveyor 53. Each section 54 contains flights 55 with transverse shafts 56, rollers 57 that run in guides 58, supporting rollers 59 and a longitudinal shaft 60. The shafts 60 of sections 54 are connected by couplings 61 and form a single shaft connected to a reciprocating mechanism mounted on the drive module 7 located on the mining platform 15. When the flights 55 are moved in the direction of transport designated by an arrow 62, they swing into a substantially vertical position and push the granular material 50 within the intermediate module 6 in the direction of transport. When the flights 55 are moved in the opposite direction, they swing into a substantially horizontal position by the resistance of the aggregate material 26 and return without pushing the aggregate material 50.

Figure 15:
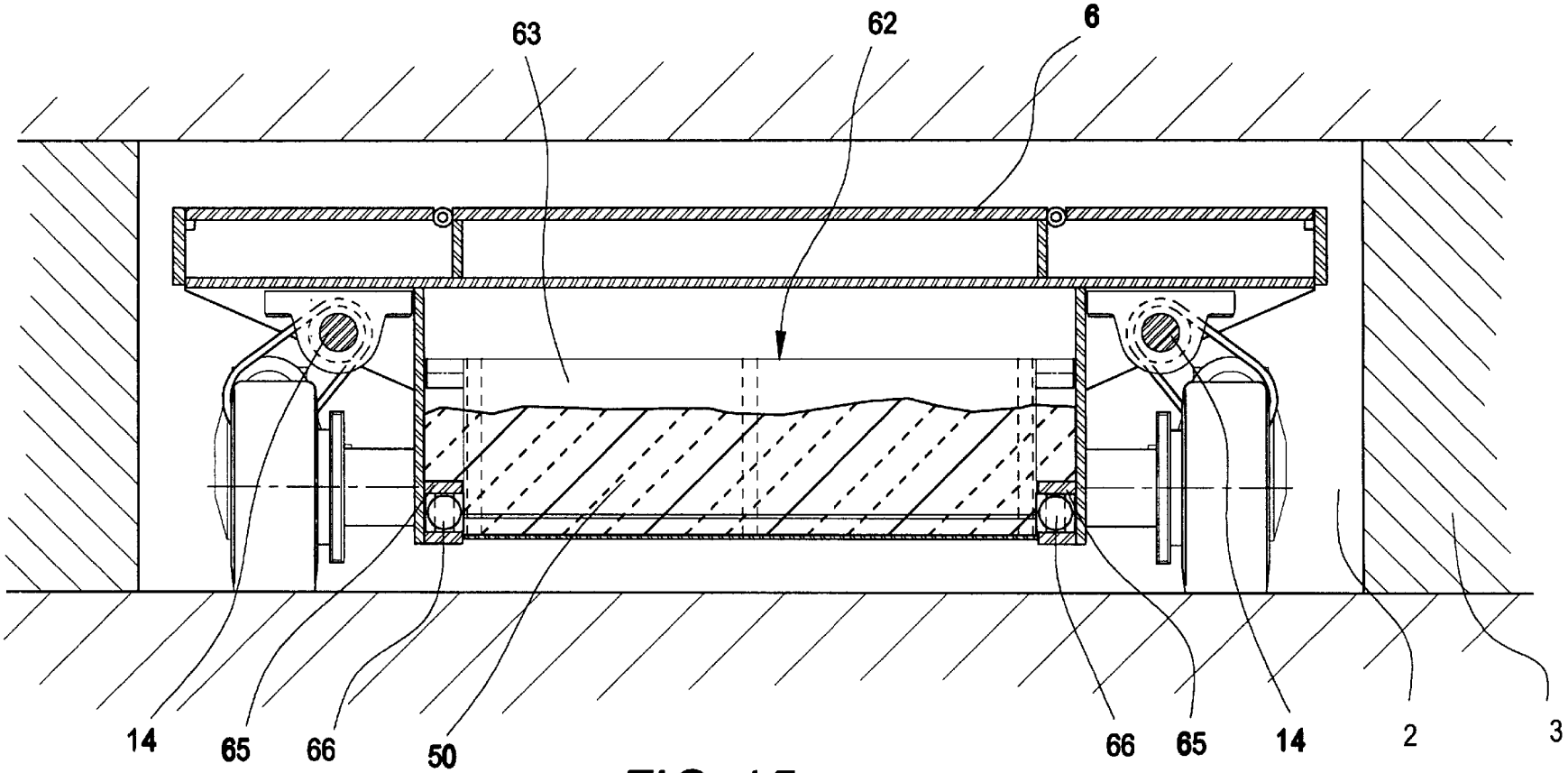
FIG. 15 is a schematic cross sectional view of another embodiment of reciprocating conveyor utilizing push plates, with push plates in a rearward motion.
Figure 16:
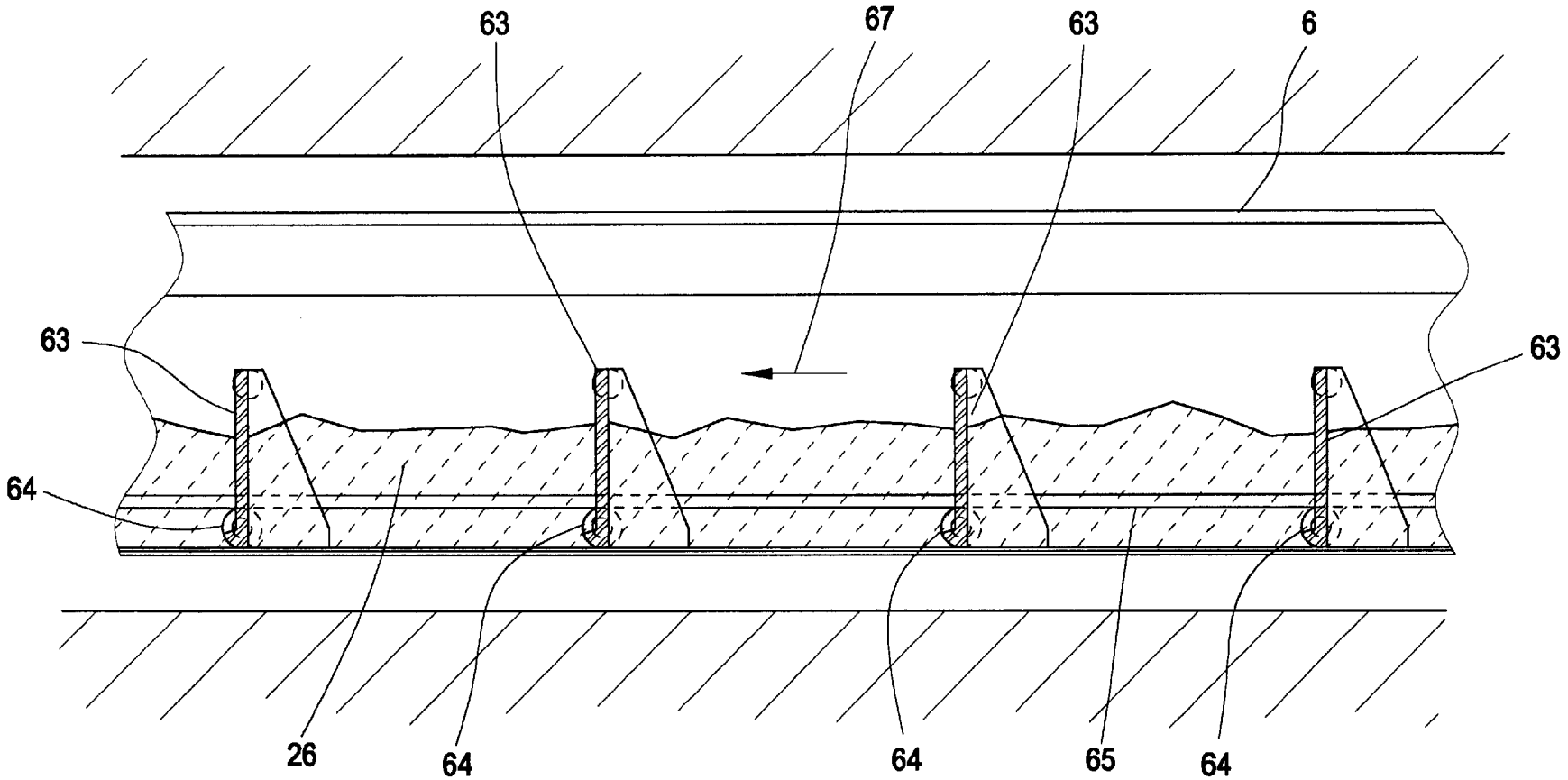
FIG. 16 is a schematic sectional view of another embodiment of reciprocating conveyor utilizing push plates, with push plates in a rearward motion.
Figure 17:
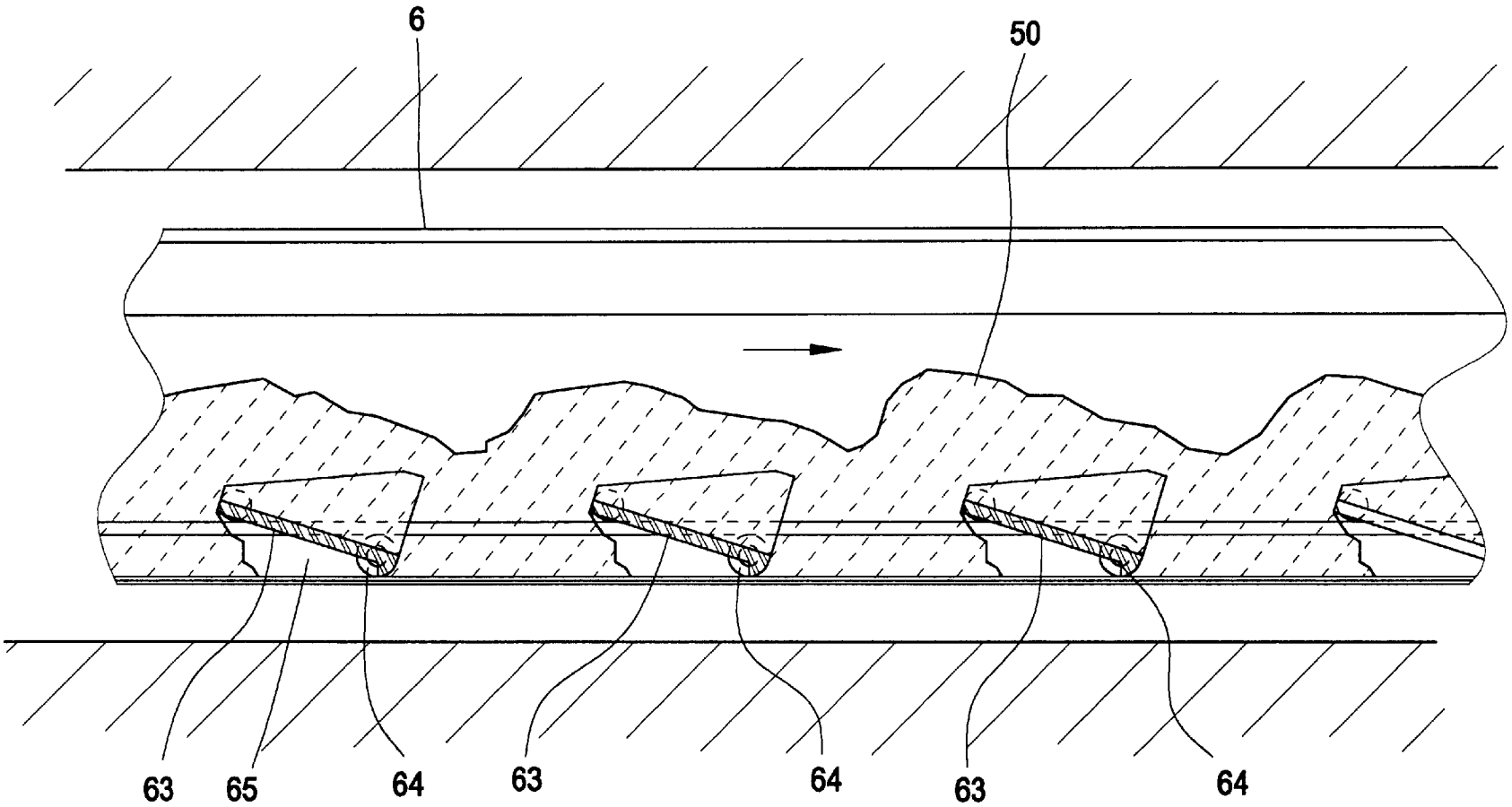
FIG. 17 is a schematic sectional view of another embodiment of reciprocating conveyor utilizing push plates, with push plates in a forward motion.

FIGS. 15 through 17 show a schematic of the intermediate modules 6 with another embodiment of a reciprocating conveyor 62 containing flights 63 with rollers 64 that run in guides 65 longitudinal linkages 66. When the flights 63 are moved in the direction of transport designated by an arrow 67, they swing into a substantially vertical position and push the granular material 50 within the intermediate module 6 in the direction of transport. When the flights 63 are moved in the opposite direction, they swing into a substantially horizontal position by the resistance of the aggregate material 50 and return without pushing the aggregate material 50.

Figure 18:
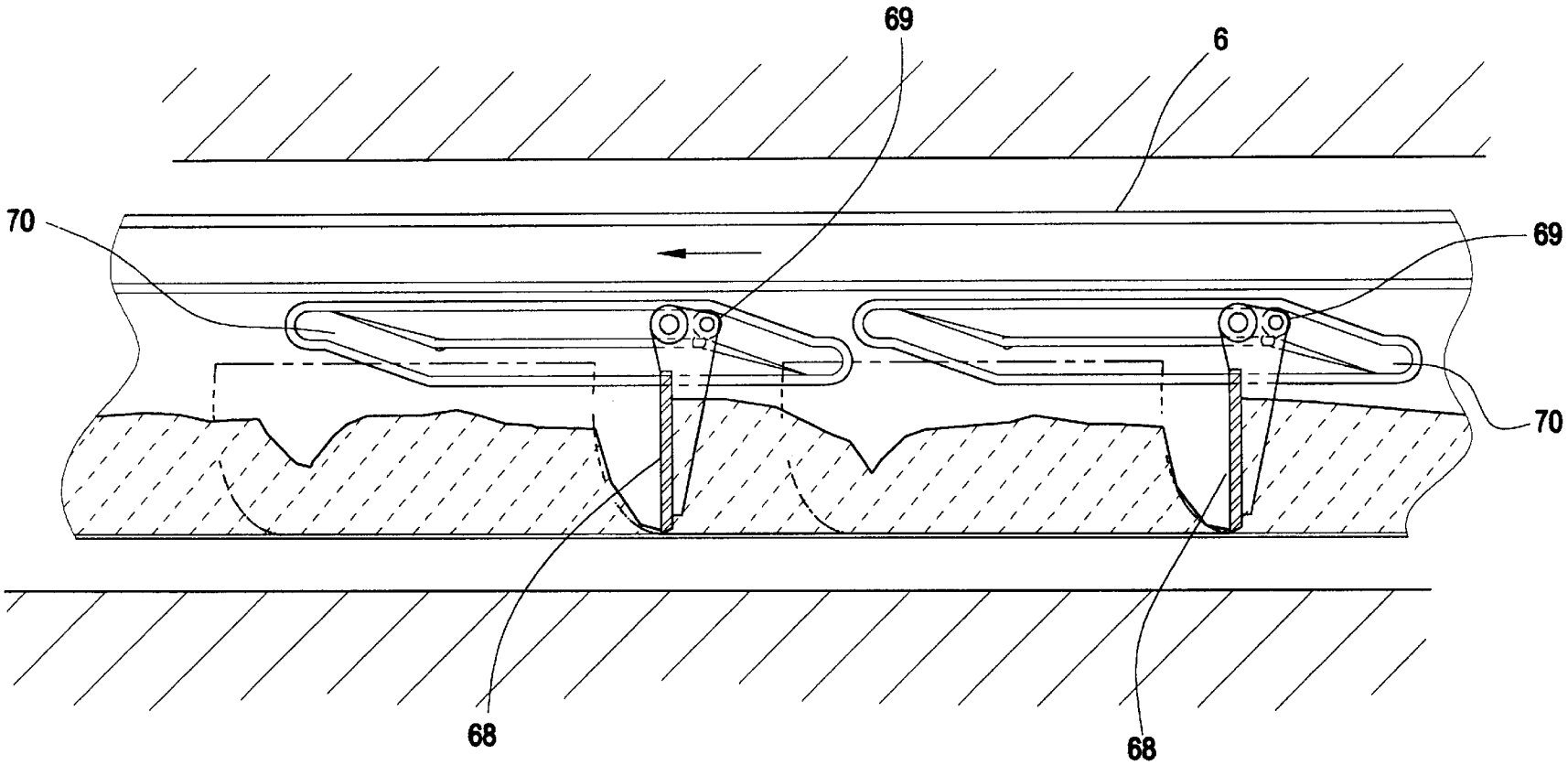
FIG. 18 is a schematic sectional view of yet another embodiment of reciprocating conveyor utilizing push plates, with push plates in a rearward motion.
Figure 19:
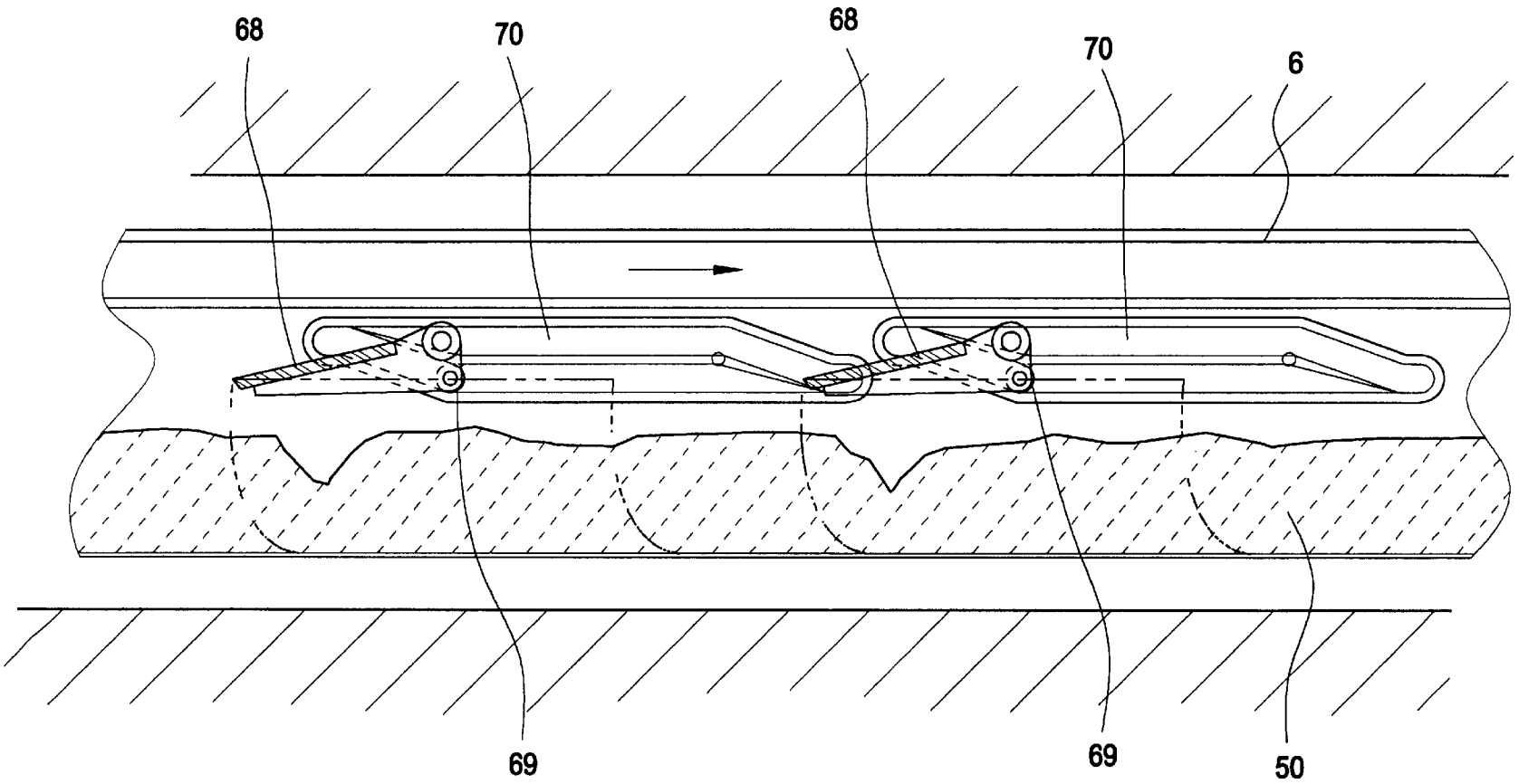
FIG. 19 is a schematic sectional view of yet another embodiment of reciprocating conveyor utilizing push plates, with push plates in a forward motion.

FIGS. 18 and 19 show a schematic of the intermediate modules 6 with yet another embodiment of a reciprocating conveyor. In this embodiment, flights 68 are moved into a substantially vertical position when moving in the direction of transport and into a substantially horizontal position when moving in an opposite direction by cams 69 moving within guides 70.

What is claimed is:

1. A method of remote mining material from a seam utilizing mining means and a self-propelled conveying means, comprising the steps of:

remotely excavating material from the said seam;

remotely conveying the said material from the said seam by a self-propelled conveying means to a suitable location;

connecting the said mining means to the said self-propelled conveying means by an independent advancing means;

advancing the said mining means into the said seam by advancing the said mining means from the forward end of the said self-propelled conveying means utilizing the said to independent advancing means;

aligning and steering the said mining means utilizing the said independent advancing means; and advancing the said self-propelled conveying means into the said seam independently of the mining means by a self-propelling means.

2. The method according to claim 1, where the tractive force required for advancing of the said self-propelled conveying means is provided at substantially regular intervals along the length of the self-propelled conveying means.

3. The method according to claim 2, where the said tractive force is provided by powered wheels engaged with a ground.

4. The method according to claim 1, where the said conveying of material is done by an interconnected conveying means having a common drive means and comprised of individual modules connected to form a train.

5. The method according to claim 1, where the said conveying of material is done by a conveying means comprised of individual conveyors connected to form a train.

6. An apparatus for remote mining of material from a seam, comprising:

mining means for remote excavating of material from the said seam;

means for remote conveying of the said material capable of propelling itself in and out of the said seam on its own power; advancing and steering means for advancing and steering the said mining means into the said seam by advancing the said mining means from the forward end of the said self-propelled conveying means;

assembling and disassembling means for the said conveying means where a plurality of individual modules of the said conveying means can be inserted from a predetermined position within the said assembling and disassembling means;

means for receiving said material from the discharge end of the said conveying means.

7. The apparatus according to claim 6, where the propelling of the said conveying means is provided by a plurality of tractive means spaced at substantially regular intervals along the length of the said conveying means.

8. The apparatus according to claim 7, where the said tractive means comprises powered wheels engaged with a ground.

9. The apparatus according to claim 8, where the power for the said powered wheels is provided by one or more drive shafts having a power input at the rearward end of the conveying means.

10. The apparatus according to claim 8, where the power for the said powered wheels is provided by one or more drive shafts having a power input at the rearward end and the forward end of the conveying means.

11. The apparatus according to claim 8, where the power for the said powered wheels is provided by one or more drive shafts having a power input the at multiple locations along the conveying means.

12. The apparatus according to claim 8, where the said powered wheels have independent power drives.

13. The apparatus according to claim 6, where the said conveying means is an interconnected conveyor having a common drive and consisting of a plurality of individual modules connected to form a train.

14. The apparatus according to claim 6, where the said conveying means consists of a plurality of individual conveyors connected to form a train.

15. The apparatus according to claim 6, where the power input for the individual conveyors is a continuous drive shaft with a power input at either one or both ends of the said conveying means.

16. The apparatus according to claim 6, where each individual conveyor has an independent power drive.

17. The apparatus according to claim 6, where the conveying means, cables and services are protected from rock falls by a protective cover.

18. The apparatus according to claim 6, where the said assembling and disassembling means includes a retractable ramp for the said conveying means to advance from the said assembling means to the seam and back.

19. The apparatus according to claim 6, where the said conveying means includes guides located within a predetermined distance from the walls of the said mine opening.

20. An apparatus for remote mining of material from a seam, comprising:

mining means for remote excavating of material from the said seam;

means for remote conveying of the said material capable of propelling itself in and out of the said seam on its own power;

steering means for steering the said mining means attached to the forward end of the said self-propelled conveying means;

assembling and disassembling means for the said conveying means where a plurality of individual modules of the said conveying means can be inserted from a predetermined position within the said assembling and disassembling means;

means for receiving said material from the discharge end of the said conveying means.

21. The apparatus according to claim 20, where the propelling of the said conveying means is provided by a plurality of tractive means spaced at substantially regular intervals along the length of the said conveying means.

22. The apparatus according to claim 21, where the said tractive means comprises powered wheels engaged with a ground.

23. The apparatus according to claim 22, where the power for the said powered wheels is provided by one or more drive shafts having a power input at the rearward end of the conveying means.

24. The apparatus according to claim 22, where the power for the said powered wheels is provided by one or more drive shafts having a power input at the rearward end and the forward end of the conveying means.

25. The apparatus according to claim 22, where the power for the said powered wheels is provided by one or more drive shafts having a power input the at multiple locations along the conveying means.

26. The apparatus according to claim 22, where the said powered wheels have independent power drives.

27. The apparatus according to claim 20, where the said conveying means is an interconnected conveyor having a common drive and consisting of a plurality of individual modules connected to form a train.

28. The apparatus according to claim 20, where the said conveying means consists of a plurality of individual conveyors connected to form a train.

29. The apparatus according to claim 20, where the power input for the individual conveyors is a continuous drive shaft with a power input at either one or both ends of the said conveying means.

30. The apparatus according to claim 20, where each individual conveyor has an independent power drive.

31. The apparatus according to claim 20, where the conveying means, cables and services are protected from rock falls by a protective cover.

32. The apparatus according to claim 20, where the said assembling and disassembling means includes a retractable ramp to enable the said conveying means to advance from the said assembling means to the said seam.

33. The apparatus according to claim 20, where the said conveying means includes guides located within a predetermined distance from the walls of the said mine opening.

34. An apparatus for remote mining of material from a seam, comprising:

mining means for remote excavating of material from the said seam;

means for remote conveying of the said material capable of propelling itself and the said mining means in and out of the said seam on its own power;

advancing and steering means for advancing and steering the said mining means into the said seam by advancing the said mining means independently of the said self-propelled conveying means;

assembling and disassembling means for the said conveying means where a plurality individual modules of the said conveying means can be inserted from a predetermined position within the said assembling and disassembling means;

means for receiving said material from the discharge end of the said conveying means.

35. The apparatus according to claim 34, where the propelling of the said conveying means is provided by a plurality of tractive means spaced at substantially regular intervals along the length of the said conveying means.

36. The apparatus according to claim 35, where the said tractive means comprises powered wheels engaged with a ground.

37. The apparatus according to claim 36, where the power for the said powered wheels is provided by one or more drive shafts having a power input at the rearward end of the conveying means.

38. The apparatus according to claim 36, where the power for the said powered wheels is provided by one or more drive shafts having a power input at the rearward end and the forward end of the conveying means.

39. The apparatus according to claim 36, where the power for the said powered wheels is provided by one or more drive shafts having a power input the at multiple locations along the conveying means.

40. The apparatus according to claim 36, where the said powered wheels have independent power drives.

41. The apparatus according to claim 34, where the said conveying means is an interconnected conveyor having a common drive and consisting of a plurality of individual modules connected to form a train.

42. The apparatus according to claim 34, where the said conveying means consists of a plurality of individual conveyors connected to form a train.

43. The apparatus according to claim 34, here the power input for the individual conveyors is a continuous drive shaft with a power input at either one or both ends of the said conveying means.

44. The apparatus according to claim 34, where each individual conveyor has an independent power drive.

45. The apparatus according to claim 34, where the conveying means, cables and services are protected from rock falls by a protective cover.

46. The apparatus according to claim where the said assembling and disassembling means includes a retractable ramp to enable the said conveying means to advance from the said assembling means to the said seam.

47. The apparatus according to claim 34, where the said conveying means includes guides.

* * * * *

UNITED STATES PATENT AND TRADEMARK OFFICE

CERTIFICATE OF CORRECTION

PATENT NO. : 6,220,670 B1
DATED : April 24, 2001
INVENTOR(S) : Dennis Mraz

It is certified that error appears in the above-identified patent and that said Letters Patent is hereby corrected as shown below:

Title page,
Item [73], the Assignee is corrected to read -- DM Technologies Ltd. --

Signed and Sealed this

Thirty-first Day of December, 2002

JAMES E. ROGAN
*Director of the United States Patent and Trademark Office*